United States Patent [19]

Turner

[11] 4,229,149

[45] Oct. 21, 1980

[54] OIL WELL PUMP

[76] Inventor: Richard L. Turner, Rte. 2, Box 138, Broken Arrow, Okla. 74012

[21] Appl. No.: 937,156

[22] Filed: Aug. 28, 1978

[51] Int. Cl.[3] ..... F04B 21/04; F04B 39/10

[52] U.S. Cl. ..... 417/554; 92/258

[58] Field of Search ..... 417/554, 552; 92/258; 277/233, 227, 166, 125, 180, 188 A, 123, 50; 220/319; 137/516.19, 533.15

[56] References Cited

U.S. PATENT DOCUMENTS

| | | | |
|---|---|---|---|
| 1,977,075 | 10/1934 | Magnuson | 92/258 |
| 2,063,839 | 12/1936 | Crooks et al. | 417/554 |
| 2,188,106 | 1/1940 | Caldwell | 92/258 |
| 2,536,836 | 1/1951 | Bowling | 137/533.11 |
| 3,282,594 | 11/1966 | Wheeler | 277/125 |
| 3,947,158 | 3/1976 | Gage | 417/554 |

*Primary Examiner*—William L. Freeh

*Attorney, Agent, or Firm*—Head & Johnson

[57] ABSTRACT

An oil well subsurface pump comprising a housing having one end thereof adapted to be secured to the lowermost end of a sucker rod, or the like, and the opposite end thereof in open communication with the fluid reservoir in a well bore, a ball check valve carried by the housing, a ball stop member disposed within the housing for limiting the movement of the ball member in one direction and having ports therein for passage of fluid upwardly through the housing, resilient sealing assembly interposed between the outer periphery of the housing and the inner periphery of the barrel and slidable with respect to the barrel during a pumping operation, and discharge ports provided in the housing in spaced relation to the sealing assembly for directing well fluid from the interior of the housing to the annulus between the housing and the working barrel for transportation of the fluid to the surface of the well bore.

2 Claims, 5 Drawing Figures

OIL WELL PUMP

BACKGROUND OF THE INVENTION

1. Field of the Invention

This invention relates to improvements in oil well pumps and more particularly, but not by way of limitation, to a reciprocal subsurface oil well pump of a minimum length and stroke for an efficient pumping operation.

2. Description of the Prior Art

In producing oil wells it is common practice to provide a pump at the bottom of the well bore, or at least down the well bore in the proximity of the producing formation. The pump is normally secured to the lowermost end of the sucker rod string, which extends longitudinally through the well bore from a reciprocating device at the surface of the ground. The reciprocating device at the surface is usually a horsehead type apparatus and alternately raises and lowers the string of sucker rods in the well bore. Subsurface pumps have long presented problems in lifting of the well fluid to the surface of the ground in that the plunger of the pump is usually several feet long which requires a relatively long stroke for operation of the pump and results in substantially great friction and drag on the pump as the pump plunger reciprocates within the working barrel. As a result, the pump may not move freely and the plunger may not have a full stroke, thus reducing pumping efficiency. In addition, since most of the subsurface pumps are relatively long, it may require several strokes of the pump before a sufficient load is applied to the pump for starting the pumping action. Also, many well fluids contain sand and other foreign particles which greatly hinder the operation of the subsurface pump and frequently damage the working parts thereof.

SUMMARY OF THE INVENTION

The present invention contemplates a bottom hole or subsurface pump for well bores which has been particularly designed and constructed for overcoming the foregoing disadvantages. The novel pump is of a relatively short overall length, as for example, ten or twelve inches and comprises a housing which is threaded at one end for connection with the lowermost sucker rod whereby the pump may be reciprocated within the working barrel simultaneously with the reciprocation of the sucker rod string. The opposite end of the pump is open for communication with the fluid reservoir in the well bore, and a ball check valve is provided in the housing for cooperation with a valve seat whereby fluid may flow into the interior of the housing on the downstroke of the pump and is precluded from entering the housing on the upstroke of the pump. A ball stop member is provided in the housing and limits the movement of the ball within the housing in one direction. The ball stop is provided with port means for passage of well fluid upwardly through the housing during a pump action and discharge ports are provided in spaced relation from the check valve for discharging the well fluid from the interior of the housing to the annulus between the outer periphery of the housing and the inner periphery of the well bore. A replaceable sealing assembly is disposed around the outer periphery of the housing and engages the inner periphery of the working barrel during the pumping operation and is spaced below the discharge ports whereby the fluid entering the annulus is moved upwardly through the well bore for recovery at the surface of the well. The sealing means is particularly constructed for an efficient sealing and is provided with integral stiffening means for greatly increasing the sealing efficiency thereof and prolonging the useful life thereof. In addition, the sealing assembly may be easily removed from the pump and replaced when necessary. The novel pump is simple and efficient in operation and economical and durable in construction.

DESCRIPTION OF THE PREFERRED EMBODIMENTS

Figure 1:
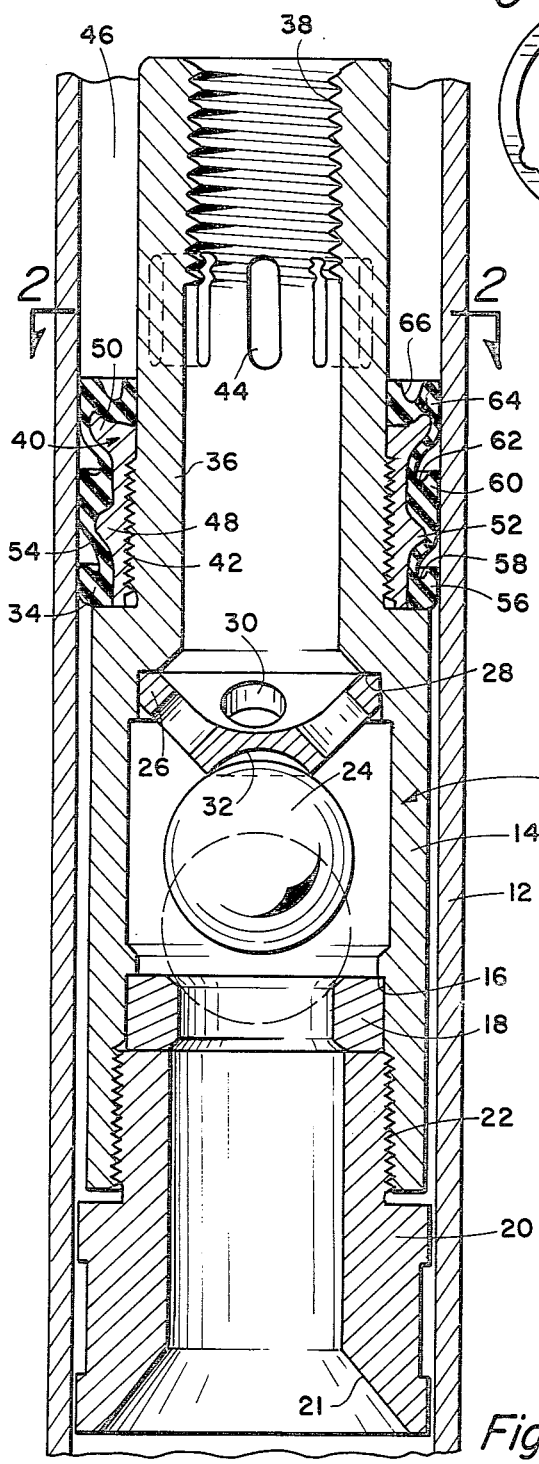
FIG. 1 is a sectional elevational view of an oil well pump embodying the invention.

Referring to the drawings in detail, reference character 10 generally indicates an oil well pump adapted to be reciprocally disposed within a working barrel 12, or the like, normally present in producing oil well bore (not shown). The working barrel 12 is preferably set with a well tubing (not shown) by a suitable packer (not shown), or the like, as is well known and in such a manner that the pump 10 is disposed in the proximity of or within the producing subsurface formation (not shown) of the well bore (not shown). However, it is to be noted that it may be desirable to retain the pump assembly 10 stationary and reciprocate the working barrel 12 with respect thereto during the pumping operation.

The pump 10 comprises a substantially cylindrical housing 14 having an inwardly directed annular shoulder 16 provided on the inner periphery thereof spaced inwardly from the lower end thereof as viewed in FIG. 1. An annular valve seat 18 is disposed within the housing 14 and is retained in position against the shoulder 16 to a sleeve 20 which is preferably threadedly secured to the lower end of the housing 14 as shown at 22. The outer end of the sleeve 20 is in open communication with the fluid reservoir (not shown) in the well bore, as is well known. The lower or outer end of the sleeve 20 is preferably bevelled or outwardly flared at the inner periphery thereof as shown at 21 for facilitating movement of the pump 10 through the well fluid and particularly at the interface (not shown).

A ball member 24 is loosely disposed within the housing 14 above the valve seat 18 and cooperates therewith to provide alternate open and closed positions for the pump 10 as will be hereinafter set forth. A substantially conical shaped stop member 26 is disposed within the housing 14 in spaced relation with the valve seat 18 for limiting the upward movement of the ball 24, and is preferably wedged or pressed into the interior of the housing against an inwardly directed annular shoulder 28 provided on the inner periphery of the housing 14. A plurality of ports or apertures 30 are circumferentially spaced around the sidewalls of the stop member 26 for permitting the passage of well fluid therethrough during a pumping operation, and an arcuate recess 32 is provided at the outer end of the conical stop member 26 for facilitating centering of the ball 24 during operation of the pump 10. In addition, it will be noted in FIG. 1 that the recess 32 provides a slight clearance between the outer periphery of the ball 24 and the stop member 26 for further assuring a more efficient operation of the ball during a pumping operation. It is considered that the self-centering feature of the stop member 26 assures a greater area or volume for flow of fluid through the pump 10 than would otherwise be possible.

The housing 14 is of a reduced diameter at 34 to provide an annular shoulder on the outer periphery thereof spaced above the stop member 26. A stem portion 36 extends upwardly from the shoulder 34 and is preferably internally threaded at the outer end thereof as shown at 38 for connection with the lowermost sucker rod on adaptor (not shown) of the usual sucker rod string normally extending longitudinally downward through the well bore. A sealing assembly generally indicated at 40 is threadedly secured around the outer periphery of the stem 36 as shown at 42 and bears against the shoulder 34. A plurality of circumferentially spaced discharge ports 44 are provided in the sidewall of the stem portion 36 and spaced outboard of the sealing assembly 40 for directing well fluid from the interior of the housing 14 to the annular space 46 between the outer periphery of the stem 36 and the inner periphery of the working barrel 12. The outer periphery of the sealing assembly 40 engages the inner periphery of the working barrel 12 for sealing between the well reservoir and the annular space 46 for a purpose as will be hereinafter set forth.

The sealing assembly 40 comprises a rigid inner sleeve member 48 preferably constructed of a suitable metal and internally threaded for engagement at 42 with the stem portion 36. The sleeve 48 is provided with an outwardly extending angular disposed flange at one end thereof and an outwardly extending circumferential shoulder 52 spaced longitudinally therefrom, as particularly shown in FIG. 1. The outer periphery of the sleeve 48 is encased with a suitable resilient material 54 such as rubber, which is bonded to the sleeve 48 in any well known or suitable manner to provide a unitary structure for the assembly 40. The casing 54 conforms generally to the configuration of the outer periphery of the sleeve 48, but is provided with an outwardly extending circumferential flange member 56 adjacent the shoulder 34 for precluding leakage of fluid therebetween. In addition, an annular recess 58 is provided in the upper or outer face of the flange 56 for trapping fluid therein in order to increase the radially outward pressure on the flange 56 to increase the sealing engagement thereof with the inner periphery of the barrel 12. A second circumferential flange 60 is provided on the outer periphery of the casing 54 in spaced relation to the flange 56, and is provided with a similar annular recess 62 on the upper or outer surface thereof for the same purpose as the recess 58. The entire outer end of the sleeve 48 is encased or covered by a third annular flange 64 which is in sealing engagement with the outer periphery of the stem 36 and the inner periphery of the barrel 12. An annular recess 66 is substantially centrally disposed on the outer surface of the flange 64 for trapping fluid therein in order that the radially inward pressure of the flange 64 against the stem 36 and the radially outward pressure of the flange 64 against the barrel 12 will be maintained at a maximum for assuring a sealing efficiency during operation of the pump 10.

In operation, the pump 10 is threadedly secured to the lowermost sucker rod (not shown) as is well known and suspended in the well bore (not shown) for reciprocation within the barrel 12 simultaneously with the sucker rod string (not shown). As the pump 10 travels downwardly in the well bore, the ball member 24 is moved upwardly within the housing 14 by the well fluid and to the position shown in solid lines in FIG. 1. In this position, the well fluid may enter the interior of the housing 14 through the open valve, whereupon the fluid may pass freely around the ball 24 and into the stem portion 36 for discharge through the ports 44 into the annular space or annulus 46. As the pump 10 travels upwardly in the well bore, the ball 24 is moved to a closed position against the valve seat 16 as shown in broken lines in FIG. 1, and well fluid cannot enter the housing 14. During the upstroke, however, the sealing assembly 40, which is in sealing engagement between the outer periphery of the pump 10 and inner periphery of the barrel 12, moves the fluid contained in the annulus 46 upwardly in the well bore, and of course repeated reciprocation of the pump 10 within the barrel 12 causes the well fluid to move upwardly through the well bore for recovery at the surface of the well.

In the event the sealing element or assembly 40 becomes worn or is otherwise damaged, the sleeve 48 may be easily removed from the stem portion 36 by unthreading the connection 42, whereupon a new assembly 40 may be installed on the pump, and a continued efficient operation of the pump will be provided.

Figure 4:
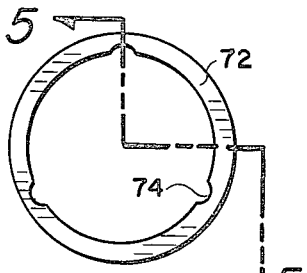
FIG. 4 is a plan view of a locking ring utilized with the sealing assembly shown in FIG. 3.
Figure 5:
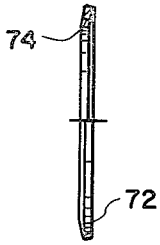
FIG. 5, is sectional view taken on line 5—5 of FIG. 4.
Figure 3:
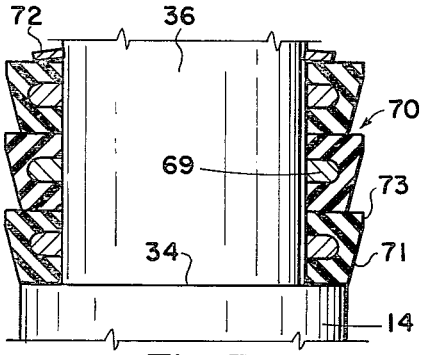
FIG. 3 is a sectional elevational view of a modified sealing assembly such as utilized in an oil well pump embodying the invention.
Figure 2:
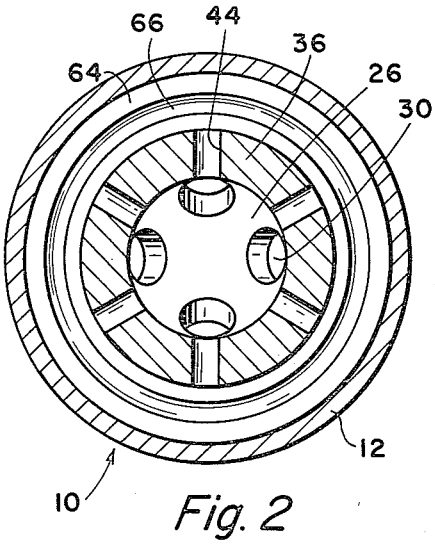
FIG. 2 is a sectional view taken on line 2—2 of FIG. 1.

Referring now to FIGS. 3 through 5, a modified sealing assembly is shown which comprises a plurality of substantially identical sealing rings 70 disposed around the outer periphery of the stem 36 in stacked relation with the lowermost ring 70 being disposed on the shoulder 34. A locking ring 72 is disposed around the outer periphery of the stem 36 in abutment with the uppermost or outermost ring 70 and bites into the outer periphery of the stem 36 for securely retaining the rings 70 in position around the stem 36 and against the shoulder 34. The outer periphery of the rings 70 engage the inner periphery of the barrel 12 and the inner periphery of the rings 70 engage the outer periphery of the stem 36 for sealing therebetween during a pumping operation as hereinbefore set forth in connection with the sealing assembly 40. Of course, the rings 70 are initially somewhat loosely disposed around the outer periphery of the stem 36 for facilitating installation thereof, but the sealing pressure of the rings 70 against the outer periphery of the stem 36 is increased by the downward pressure of the ring 72 against the outermost ring 70, which in turn causes each ring 70 to be urged against the next lower ring 70 for assuring an efficient sealing by each ring 70.

The rings 70 comprise a central annular ring member 69 constructed from a suitable stiff or rigid material such as metal, with a resilient material such as a suitable rubber bonded to the opposite faces and the outer periphery thereof. Thus, the rings 70 flex sufficiently for radial expansion into a sealing engagement between the stem 36 and the barrel 12 in response to the longitudinal pressure placed thereon by the installation of the locking ring 72. In addition, the outer periphery of each ring 70 is preferably inwardly tapered as shown at 71 for forming a substantially straight or cylindrical lip portion 73 around one end of the ring 70. The lip 73 improves the sealing characteristics of the ring and the core or inner ring 69 provides a "back up" for the yieldable characteristics of the resilient material.

The locking ring 72 is of a generally annular configuration, but is substantially conical, as shown in FIG. 5, in the normal relaxed position thereof whereby the inner diameter thereof is slightly greater than the outer diameter of the stem 36 for facilitating installation of the ring 72 thereon. However, when the ring 72 is installed on the stem 36, longitudinal pressure is applied to the ring 72 in any suitable or well known manner for flattening the configuration of the ring 72 whereby the inner diameter thereof becomes slightly less than the outer diameter of the stem 36. Thus, the inner periphery of the locking ring 72 "bites" into the outer periphery of the stem 36 for securely retaining the rings 70 in an efficient sealing position thereon. In addition, a plurality of circumferentially spaced grooves or recesses 74 are provided on the inner periphery of the ring 72 whereby the ring 72 may be cut apart at the location of the recesses without damage to the outer periphery of the stem 36, thus facilitating removal of the ring 72 from the stem 36 when it becomes necessary to replace the sealing rings 70 for any reason.

From the foregoing it will be apparent that the present invention provides a novel oil well subsurface pump which is extremely efficient for pumping well fluid to the surface of the well bore for recover thereof. The novel pump includes a ball check valve having an improved self-centering ball stop member cooperating therewith for assuring an increased fluid volume flow through the open valve during a pumping operation. In addition, novel removable sealing means is provided for the pump which are sufficiently resilient for providing a good seal and sufficiently rigid for providing a relatively long life therefor. The sealing means may be readily removed and replaced in a minimum of time and effort, thus reducing the cost of operation of the pump.

Whereas the present invention has been described in particular relation to the drawings attached hereto, it should be understood that other and further modifications, apart from those shown or suggested herein may be made within the spirit and scope of this invention.

What is claimed is:

1. A subsurface well pump for disposition within a working barrel of a well bore and arranged for reciprocal movement therebetween, said pump comprising housing means having one end in communication with a well fluid reservoir, ball check valve means carried by the housing means for providing alternate open and closed positions for the pump during operation thereof, self-centering ball stop means disposed within the housing means for cooperation with the ball check valve means for efficient operation thereof in an open position of the pump for admission of the well fluid to the interior of and longitudinally through the housing, discharge means provided in the housing for discharging well fluid from the interior of the housing to an annulus between the housing means and the working barrel for elevation of the well fluid to the surface of the well during operation of the pump, sealing means removably secured to the outer periphery of the housing means and in sealing engagement with the outer periphery of the housing means and the inner periphery of the working barrel for sealing the annulus from the well fluid reservoir, said sealing means comprising a plurality of substantially identical sealing rings having rigid core members removably disposed in stacked relation around the outer periphery of the housing means, each of said core members having a resilient material bonded to the outer periphery thereof for sealing engagement between the adjacent sealing ring and the outer periphery of the housing means and the inner periphery of the working barrel, and means removably engageable with the outermost sealing ring for securely locking the sealing rings in position around the housing means, and wherein the last mentioned means comprises an annular ring of substantially conical cross-sectional configuration wherein the inner diameter of the ring in the normal relaxed position thereof is slightly greater than the outer diameter of the housing means and in a flattened position of the ring the inner diameter thereof is slightly less than the outer diameter of the housing means whereby the inner periphery of the ring bites into the outer periphery of the housing means for securely locking the sealing rings in the sealing position around the housing means.

2. A subsurface well pump as set forth in claim 1 wherein the annular ring is provided with at least one recess on the inner periphery thereof for facilitating severing of the ring for removal thereof from the locked position with respect to the housing means.

* * * * *